US006530787B2

(12) United States Patent
Harting et al.

(10) Patent No.: US 6,530,787 B2
(45) Date of Patent: Mar. 11, 2003

(54) COAXIAL PLUG CONNECTOR FOR MOUNTING ON A CIRCUIT BOARD

(75) Inventors: Dietmar Harting, Espelkamp (DE); Günter Pape, Enger (DE); Manfred Berghorn, Stolzenau (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/737,978

(22) Filed: Dec. 15, 2000

(65) Prior Publication Data

US 2001/0004555 A1 Jun. 21, 2001

(30) Foreign Application Priority Data

Dec. 16, 1999 (DE) ..... 199 60 856

(51) Int. Cl.[7] ..... H01R 12/00
(52) U.S. Cl. ..... 439/83; 439/63
(58) Field of Search ..... 439/352, 353, 439/578, 357, 188, 668, 358, 79, 83

(56) References Cited

U.S. PATENT DOCUMENTS 4,056,302 A * 11/1977 Braun et al. ..... 439/275
4,678,250 A * 7/1987 Romine et al. ..... 439/83
4,925,392 A * 5/1990 Himes, Jr. et al. ..... 439/55
5,438,617 A * 8/1995 Hill et al. ..... 379/327
5,746,619 A * 5/1998 Harting et al. ..... 439/52
6,104,866 A * 8/2000 DeWitt et al. ..... 392/390
6,124,716 A * 9/2000 Kanamori ..... 324/538
6,273,751 B1 * 8/2001 Francaviglia ..... 439/511

FOREIGN PATENT DOCUMENTS

| | | |
|---|---|---|
| DE | 195 34 019 A1 | 3/1997 |
| DE | 196 04 432 C2 | 12/1997 |
| DE | 198 05 944 C1 | 9/1999 |
| EP | 1 020 956 A1 | 7/2000 |

* cited by examiner

*Primary Examiner*—Neil Abrams
*Assistant Examiner*—J. F. Duverne
(74) *Attorney, Agent, or Firm*—Cook, Alex, McFarron, Manzo, Cummings & Mehler, Ltd.

(57) ABSTRACT

In a plug connector for mounting on a circuit board and having a carrier body (10, 12) in which at least one surface mounting contact member (20) is disposed which comprises, at one end, a plug region for connection with a complementary plug connector and, on the other end, a connecting region (22) which may be connected with the conductor track of the circuit board (52), a reliable soldering to the conductor track of the circuit board shall be ensured irrespective of possible tolerances. For this purpose it is provided that the contact member comprises a connecting member (24) which is connected with the connecting region (22) in a mechanically flexible and electrically conductive manner and may be soldered to the conductor track of the circuit board (52).

20 Claims, 8 Drawing Sheets

COAXIAL PLUG CONNECTOR FOR MOUNTING ON A CIRCUIT BOARD

The invention relates to a plug connector for mounting on a circuit board and having a carrier body in which at least one surface mounting contact member is disposed which comprises, at one end, a plug-in region for connection with a complementary plug connector and,-at the other end, a connecting region which may be connected with the conductor track of a circuit board.

The surface mounting technology offers some advantages over conventional plug connectors which are provided with pass-through mounting contact members, both during the mounting process and as regards the transmission speed for signals from the surface mounting contact member to the conductor track of the circuit board. In order to accomplish a reliably soldered connection, particular attention must be paid to the coplanarity of the terminal ends during the manufacturing process for the plug connectors. It has turned out that the height deviation of the connecting region must not exceed 0.1 mm if all connections shall be safely soldered. However, such slight tolerances may only be ensured either via a very expensive manufacturing process leading to a product which reliably keeps to the corresponding tolerances, or via a sorting process following the manufacturing process, in which all those plug connectors are sorted out which do not keep to the required tolerances. However, this leads to a high reject rate and, accordingly, to high overall production costs.

Another problem with regard to surface mounted contact members consists in that the soldered joint between the contact member and the circuit board is less rigid than a soldered joint with through-type contact members, more particularly under shear stress. On the one hand, this fact is critical in view of the forces acting on the plug connector during insertion into a complementary plug connector and, on the other hand, in view of mechanical stresses arising from differences in the thermal expansion of the circuit board and the plug connector or due to flexure of the circuit board.

Therefore it is the object underlying the invention to further develop a plug connector of the type initially mentioned to the effect that despite low manufacturing expenditure a reliable connection is guaranteed between the connecting region of the surface mounting contact member and the conductor track of the circuit board and that significant mechanical forces are prevented from acting on the soldered connection after soldering.

In order to meet this object, it is provided for in accordance with the invention that the contact member comprises a connecting member which is connected with the connecting region in a mechanically flexible and electrically conductive manner and may be soldered to the conductor track of the circuit board. The basic idea underlying the plug connector according to the invention resides in configuring the surface mounting contact member in multiple parts and in taking advantage of a predetermined slidability between the different parts, i.e. the actual contact member and the connecting member in particular, for tolerance compensation during assembly of the plug connector on the one hand and for permanent movability during operation of the plug connector on the other hand. The tolerance compensation, which is now realized automatically, reduces manufacturing process requirements so that there result lower costs. Mechanical decoupling between the circuit board and the surface mounting contact member increases the durability of the soldering points since there occurs a relative displacement between the connecting member and the contact member, but no mechanical strain on the soldering points when certain mechanical stresses between the circuit board and the contact member are exceeded.

Preferably, it is provided that the connecting member is slidably mounted on the connecting region. Thus, the connecting member may be attached to the surface mounting contact member before the plug connector is mounted on the circuit board already and need not be handled as a separate component during the assembly process.

According to the preferred embodiment, it is provided that, before the plug connector is mounted on the circuit board, the connecting member is in a mounting position in which it projects farther from the plug connector than after mounting. In this manner, the desired tolerance compensation results automatically when the plug connector is put onto the circuit board since the projecting connecting members are shifted into the correct position during putting-on.

According to the preferred embodiment, it is further provided that the connecting member is a resilient clamp engaging the connecting region. On the one hand, this spring effect may ensure that the desired contact force between the clamp and the connecting region of the surface mounting contact member exists even after a long operating time. On the other hand, one may adjust via the spring force amount which mechanical stress must act between the surface mounting contact member and the connecting member before there will occur a relative displacement.

According to a preferred variant, it is provided that the connecting member is formed to be spherical. This makes it possible to contact the connecting region from almost any direction since there always result two diametrically opposite contact points on the connecting region, irrespective of slight relative displacements.

The contact member is preferably provided with an insulating body which constitutes a guide for the clamp. The guide ensures that the clamp is in the desired position before assembly of the plug connector so that it is automatically shifted from the mounting position into the correct position for soldering. The guide is more particularly required in conjunction with the spherical connecting region since the latter cannot provide any guide for the clamp.

The insulating body is preferably provided with contact faces for the clamp, which are opposite each other at a spacing larger than the corresponding dimension of the clamp in this region. This dimensioning of the parts relative to each other not only enables a translatory shifting of the clamp on the guide, but also a pivot and tilt movement which may be necessary for the compensation of mechanical stresses which may result from bending of the circuit board or from differences in the thermal expansion between the plug connector and the circuit board.

According to an alternative variant, it is provided that the connecting region has a rectangular cross-section. In this case, a guide for the connecting member is realized due to the shape of the connecting region already. The alternative variant preferably provides that the clamp is provided with several guide surfaces which may engage opposite edges of the connecting regions. This makes sure that the clamp does not laterally slip off the connecting region. The guide surfaces may be formed on bent-off noses of the clamp.

According to the preferred embodiment, it is provided that the resilient clamp comprises two legs engaging the connecting region, and a bottom connecting the two legs with each other and facing towards the circuit board, and that the bottom is provided with a spacer which ensures a predetermined spacing between the bottom and the circuit board. The spacer prevents the bottom of the clamp from bearing against the circuit board during assembly of the plug connector and from fully forcing the solder paste, which had previously been applied to the circuit board, away in this region, which would result in an inadequate solder joint.

It is preferably provided that the spacer is formed as a raised portion which may bear with its apex against the circuit board. The apex of the raised portion forms a tip which reliably penetrates the solder paste. This makes sure that the spacer actually bears against the circuit board rather than against a solder paste pad so that the correct spacing between the bottom of the clamp and the circuit board is ensured.

According to an alternative embodiment, it may be provided that the connecting member is connected with the connecting region via a bond wire. Thus, a further additional component is used in this case in order to create the electrically conductive connection between the connecting member and the connecting region of the contact member. The bond wire enables relative movability of the parts.

According to the preferred embodiment of the invention, there is further provided at least one pass-through mounting contact member. In this manner, two advantages result therefrom: on the one hand, the pass-through mounting contact member enables a sort of preliminary fixing of the plug connector after it has been put onto the circuit board and before soldering. On the other hand, the pass-through mounting contact member ensures, due to its higher holding force in the circuit board, good mechanical fixing of the plug connector so that there is less strain on the soldered joints of the surface mounting contact members from forces acting on the plug connector.

Preferably, the pass-through mounting contact member is an earth contact and the surface mounting contact member is a signal contact. This configuration takes into account the advantages offered by a surface mounting contact member in view of signal velocity; maximum signal velocity is of secondary importance for an earth contact.

According to one embodiment of the invention, the plug connector is a card-edge plug connector. Plug connectors of that kind are used for a multipole and pluggable connection between a circuit board and a cable and, respectively, another circuit board for the transmission of electrical signals. The contact members are disposed in an insulating body in rows and columns. Via a suitable combination of surface mounting contact members and pass-through mounting contact members there may be obtained a card-edge plug connector which is both anchored on the circuit board with high mechanical strength, namely by means of the pass-through mounting contact members, and offers a high signal transmission velocity, namely due to the surface mounting contact members. No longer does the problem occur, which had hitherto arisen in the prior art, namely that the surface mounting contact members of a card-edge plug connector are shear-strained due to the location of the plug connector since, on the one hand, the pass-through mounting contact members introduce a large part of the occurring forces directly into the circuit board and, on the other hand, a possible relative displacement between the plug connector and the circuit board does not result in any stress on the soldered joints between the surface mounting contact members and the conductor tracks since the multi-part configuration of the contact member enables a relative displacement with the connecting member.

According to a further embodiment, it is provided that the plug connector is a coaxial-contact plug connector. This configuration also takes advantage of the combination of a surface mounting contact member and a pass-through mounting contact member, more particularly when the surface mounting contact member constitutes an inner conductor of a coaxial contact member and the pass-through mounting contact member is an earth sheet metal connected with an outer conductor of the coaxial contact. Reference is made to the above explanations in respect of the advantages of this combination of a signal contact and an earth contact.

Advantageous configurations of the invention may be taken from the sub-claims.

In the following, the invention will be described upon reference to two preferred embodiments which are represented in the enclosed drawings. Therein:

FIGS. 1 and 4 show a plug connector according to a first embodiment of the invention. This concerns an angled coaxial plug connector provided for mounting on a circuit board.

Figure 1:
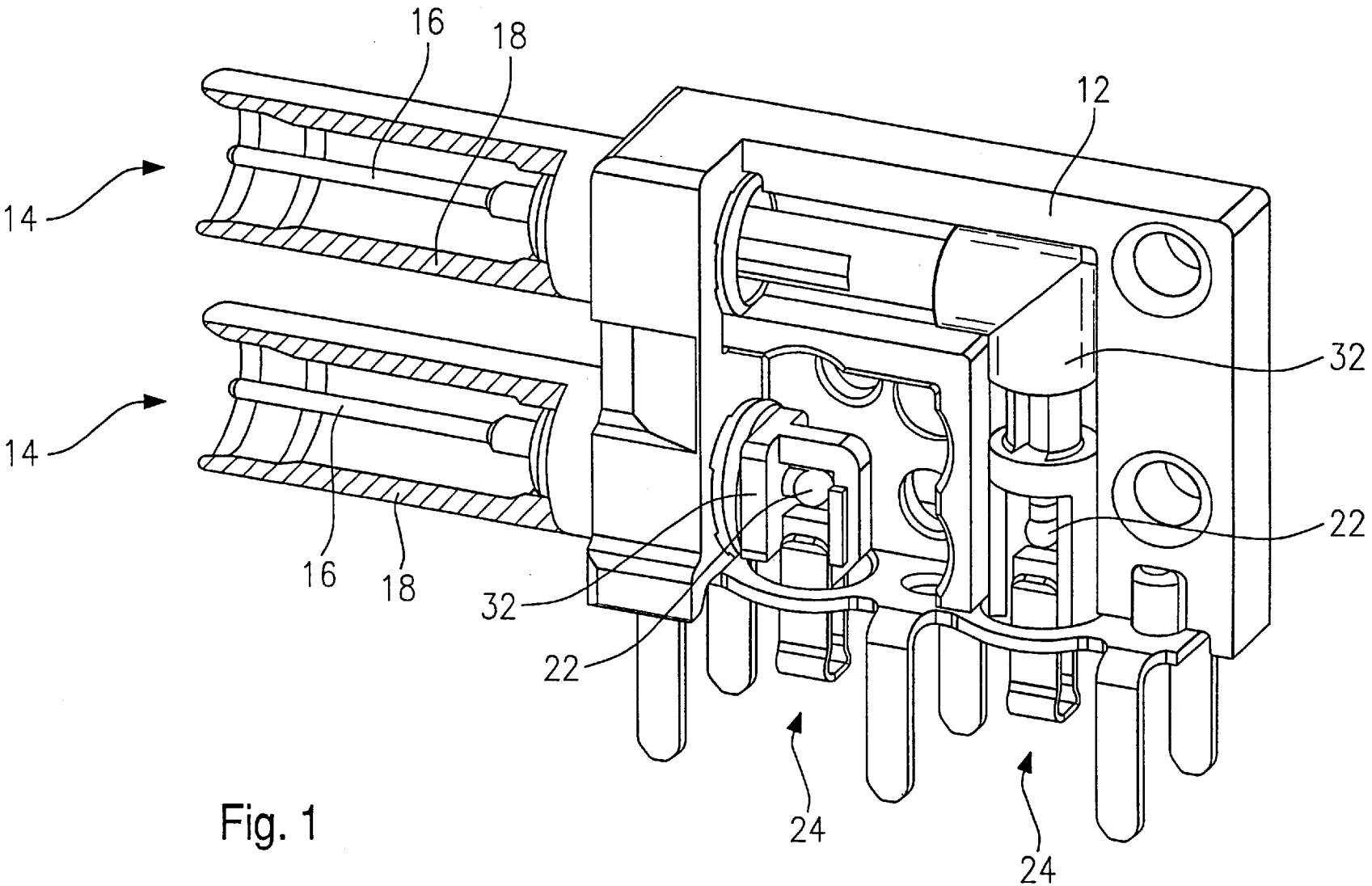
FIG. 1 is an isometric sectional view of a plug connector according to a first embodiment of the invention.
Figure 2:
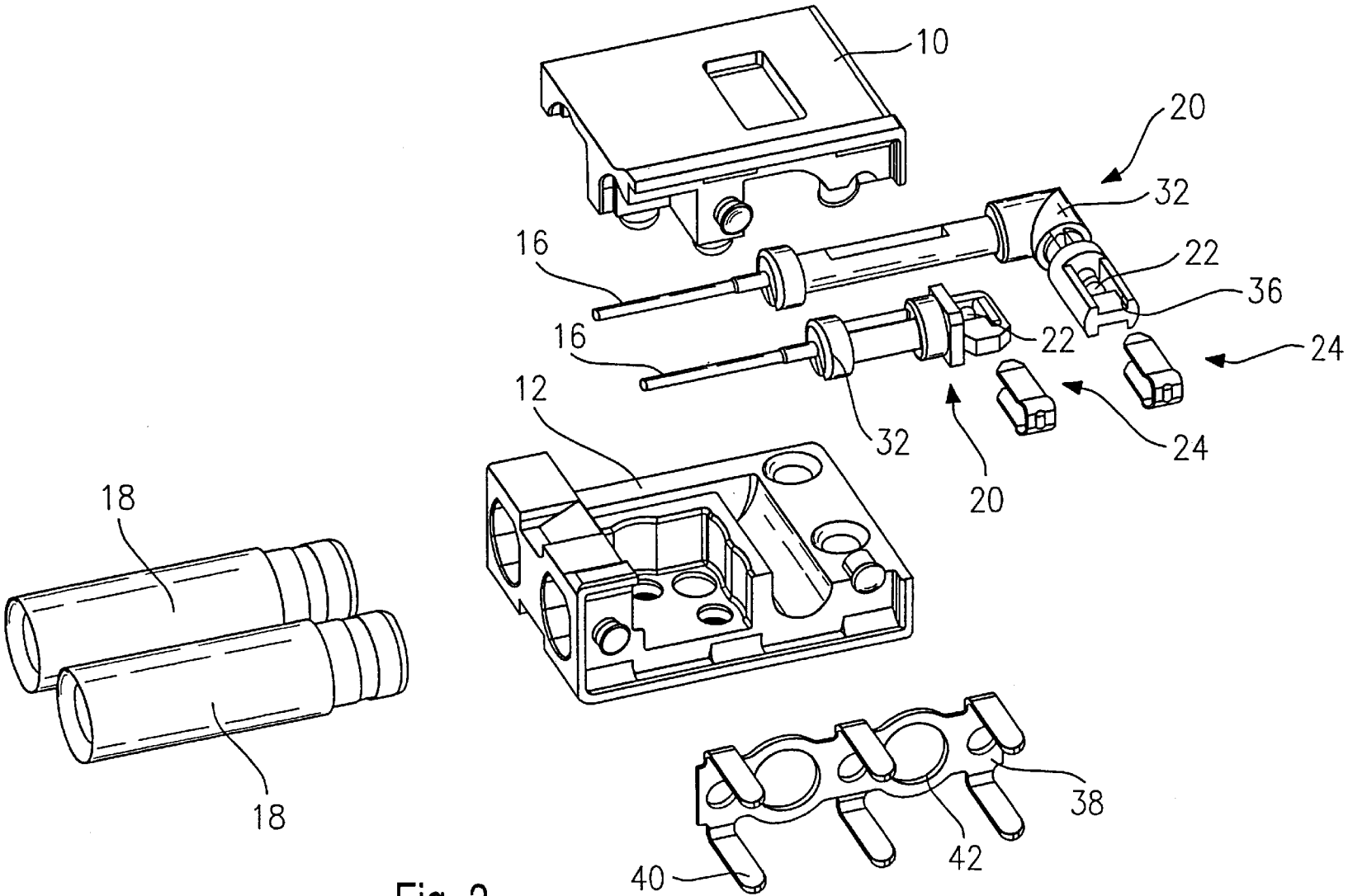
FIG. 2 is an isometric representation of the individual components of the plug connector of FIG. 1.

The plug connector comprises a carrier body formed of two housing portions 10, 12 which consist of metal and in which coaxial plug contacts 14 are accommodated. Metallized plastic may alternatively used as the material for the housing portions 10, 12 too. In any event, the housing must be electrically conductive to ensure shielding.

The two coaxial plug contacts 14 each consist, in a known manner, of a pin-shaped inner conductor 16 and a sleeve-shaped outer conductor 18. The sleeve-shaped outer conductor is electrically conductive and is in electrically conductive connection with the housing constituted by the two housing portions 10, 12.

The inner conductor 16 is part of a surface mounting contact member 20 which extends up to the connecting side of the plug connector, i.e. towards that side with which the plug connector is mounted on the circuit board.

Figure 3:
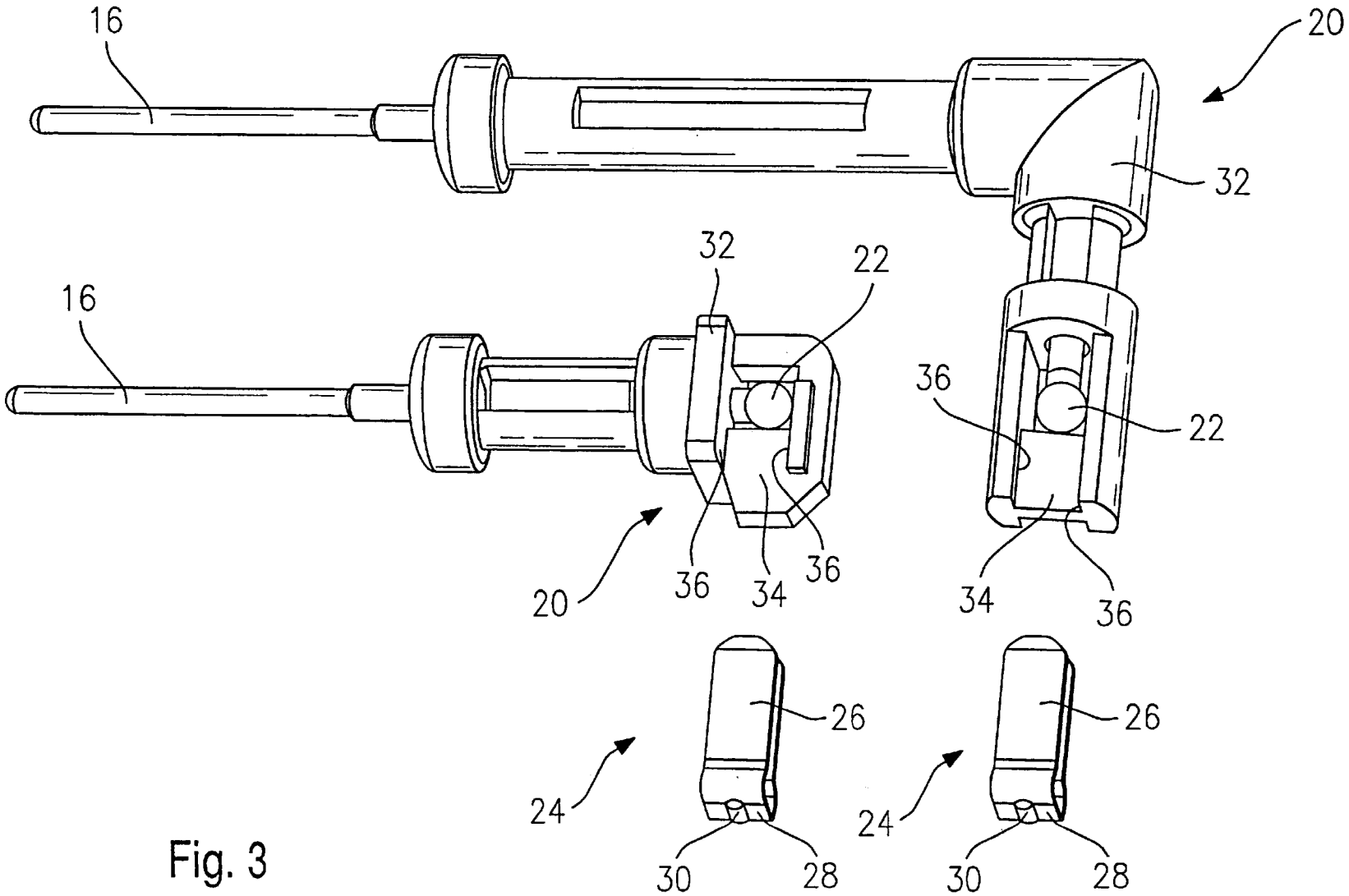
FIG. 3 is an enlarged view of the surface mounting contact members used in the plug connector of FIG. 1.

The surface mounting contact member 20 (see FIG. 3 in particular) comprises a connecting region 22 which is configured to be spherical. The surface mounting contact member 20 further comprises a connecting member 24 which is provided for engaging the connecting region 22 in electrically conductive connection. Here, the connecting member 24 is formed as a resilient clamp with two legs 26 being connected to each other by means of a bottom 28. On the bottom, there is provided, on the side facing away from connecting region 22, a spacer 30 which is configured as a stamping in such a manner that a comparatively pointed apex is formed. The function of the spacer 30 will be explained in the following.

The surface mounting contact member 20 further comprises an insulating body 32 which serves for insulation against the electrically conductive housing. Insulating body 32 is configured as a guide for connecting member 24 about the connecting region 22 of the surface mounting contact member 20. The guide consists of a guide web 34 and contact faces 36 for limiting the guide web 34. Locating surfaces 36 are situated opposite each other at a spacing which is larger than the width of the legs 26 so that the connecting member 24 may be slightly tilted in the guide.

Finally, the plug connector is provided, on the connecting side, with a pass-through mounting contact member 38 which is formed as an earth sheet metal. This one is in electrically conductive connection with the housing constituted by the two housing portions 10, 12 and comprises terminal legs 40 engaging, for instance, corresponding openings of the circuit board, on which the plug connector is to be mounted, as well as recesses 42 through which the surface mounting contact member respectively extends.

Figure 4:
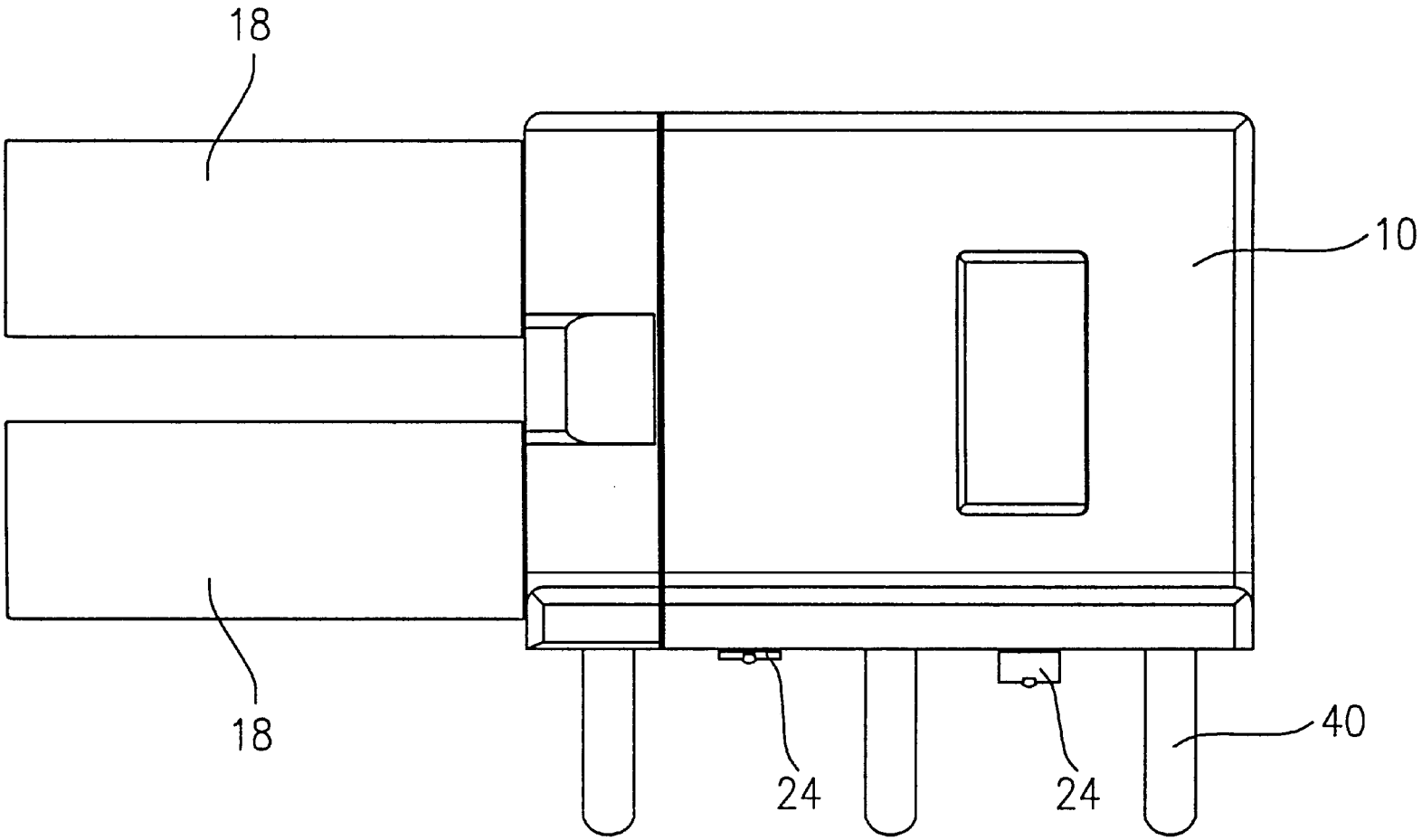
FIG. 4 is a side view of the plug connector of FIG. 1 with two connecting members in two different positions.

For assembly, the surface mounting contact members 20, the sleeve-shaped outer conductor 18 as well as the earth sheet metal serving as the pass-through mounting contact member 38 are inserted in suitable receptions of the two housing portions 10, 12. The connecting member 24 may be slipped onto the guide web 34 of the insulating body 32 up to a mounting position in which it is autofixed on the surface mounting contact member. This position is shown in FIG. 4 in respect of the right connecting member 24.

In this finished assembled condition, the coaxial plug connector may be mounted on a circuit board. For this purpose, the circuit board is first coated with a solder paste at the locations which are provided for connection with the inner conductor 16 of the coaxial plug contacts 14. Subsequently, the to coaxial plug connector is put onto the circuit board, the terminal legs 40 of the pass-through mounting contact member 38 penetrating into suitable openings of the circuit board. During the process of putting the plug connector onto the circuit board, the connecting member 24 immerses into the previously applied solder paste, the spacer 30 reliably forcing away and penetrating the solder paste with its apex so that it rests on the circuit board. This ensures that the bottom 28 comprises, in all the remaining regions, a predetermined spacing from the circuit board, which is given by the height of the spacer, preferably is 0.1 mm and is completely filled with solder paste.

The mounting position of the contact members 24 is selected such that the spacer 30 bears against the circuit board before the terminal legs 40 are completely pushed into the circuit board. Thus, there results a relative displacement between the connecting member 24 and the connecting region 22 approximately at the end of the process of putting the plug connector onto the circuit board, whereby the legs 26 of the connecting member formed as a clamp are pushed onto the connecting region 22. This condition, in which the electrical connection between the connecting member 24 and the inner conductor 16 is ensured independently of the respectively existing tolerances, is shown for the left connecting member 24 in FIG. 4.

As soon as the plug connector is correctly put onto the circuit board, the surface mounting contact members may be soldered, a reliable soldering being ensured due to the precisely kept spacing between the bottom of the connecting member 24 and the circuit board. This spacing between the bottom 28 of the connecting member 24 and the circuit board is not influenced by tolerances of the plug connector or by an uneven circuit board surface since possible tolerances are compensated in that the contacting member is pushed onto the connecting region 22 of the surface mounting contact member in differing lengths.

Figure 5:
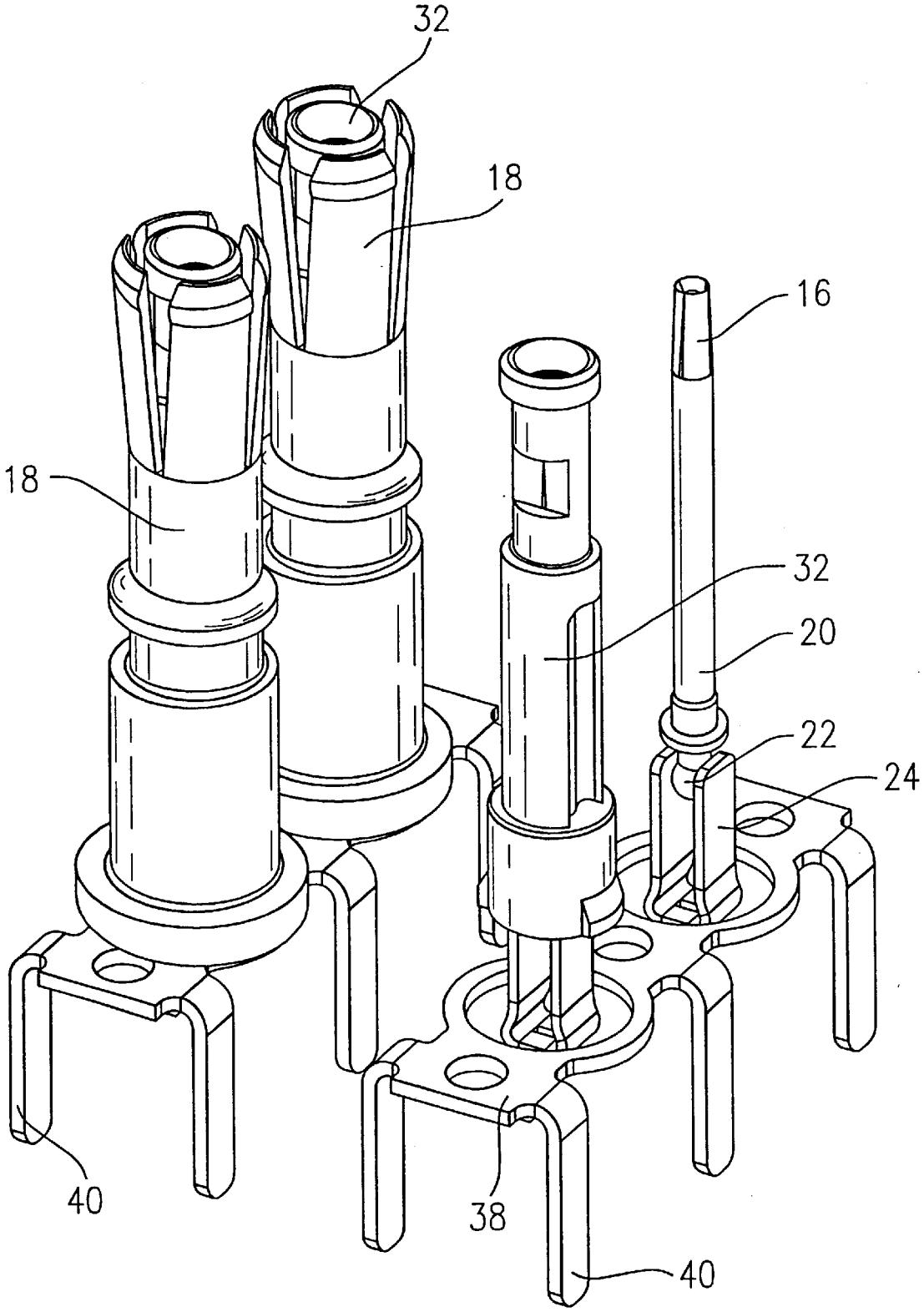
FIG. 5 is an isometric representation of the contact members according to a variant of the plug connector shown in FIG. 1, some components not being shown for better clarity.

FIG. 5 shows the surface mounting contact members as well as the pass-through mounting contact members for a coaxial plug connector which slightly alters the embodiment of FIG. I and is no longer formed to be angled, but comprises rectilinearly extending contact members. The surface mounting contact members of the variant shown in FIG. 5 substantially corresponds to the shorter surface mounting contact member of the embodiment shown in FIGS. 1 to 4. The difference merely consists in that the connecting member 24 does no longer engage the connecting region 22 transversely with respect to the longitudinal direction of the contact member, but is pushed onto the connecting region parallel with respect to the longitudinal direction of the contact member. The contact as such, which results between the legs of the connecting member 24 and the connecting region 22, remains unchanged since two diametrically opposed contact spots result independently of the direction in which the connecting member is pushed onto the connecting region.

Figure 6:
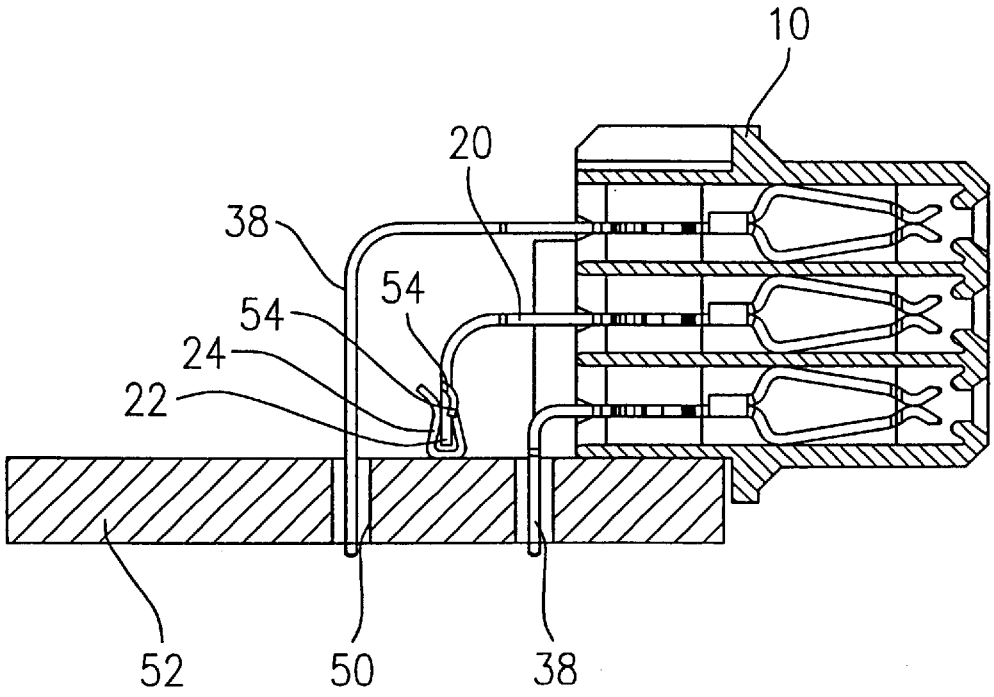
FIG. 6 is a sectional side view of a plug connector according to a second embodiment of the invention.

FIG. 6 shows a plug connector according to a second embodiment of the invention. This concerns a card-edge plug connector serving for the connection of circuit boards. It usually comprises a plurality of contacts which are disposed in several adjacent columns. Just a single column may be seen in the sectional representation of FIG. 6.

The embodiment shown concerns an angled multiple-contact strip since the individual contacts are each angled by 90° and formed as contact springs on the connecting side of the plug connector. Consistent therewith, the complementary plug connector which is inserted into the shown plug connector is a blade-contact strip. Of course the embodiment shown may also be formed as a blade-contact strip.

In this embodiment, the housing portion 10 constitutes an insulating carrier body which may optionally be provided with a shielding. The individual contacts are held in the carrier body, they consisting of two pass-through mounting contact members 38 which on their connecting side engage openings 50 of a circuit board 52 as well as of a surface mounting contact member 30 being provided with a connecting member 24 on its connecting side. The precise configuration of the connecting member 24 as well as the cooperation with the surface mounting contact member 20 will be explained in the following.

Figure 7:
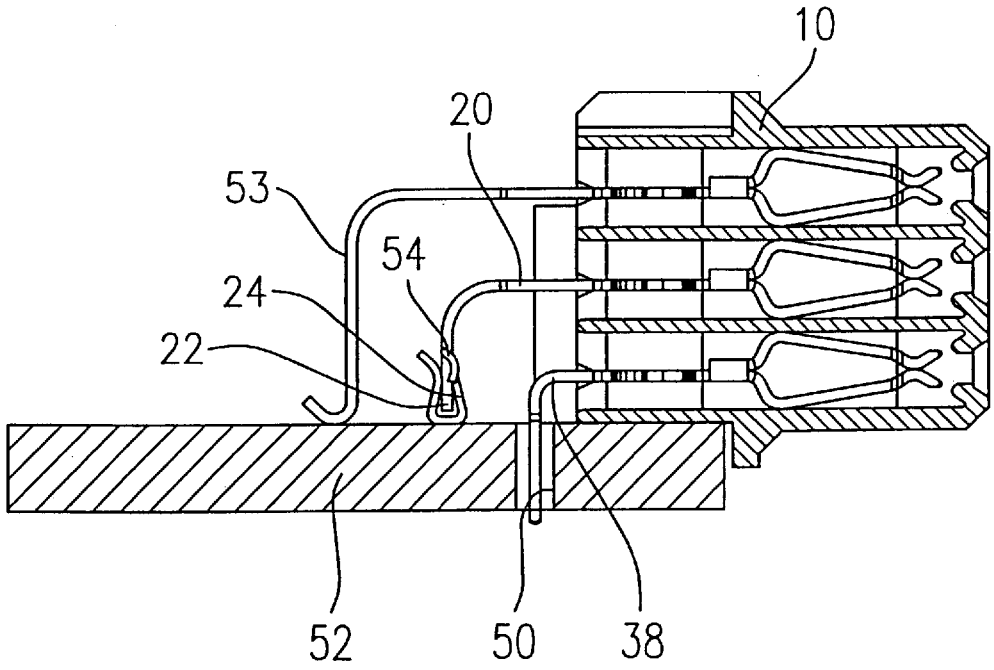
FIG. 7 is a sectional view of a plug connector according to a variant of the embodiment shown in FIG. 6.

FIG. 7 represents a variant of the embodiment shown in FIG. 6. In contrast to the embodiment of FIG. 7, a contact member 53 is provided instead of the outer pass-through mounting contact member 38, which member 53 has a bend at its connecting end which rests on the circuit board and may be connected there with a corresponding conductor track in surface mounting technology.

Figure 8:
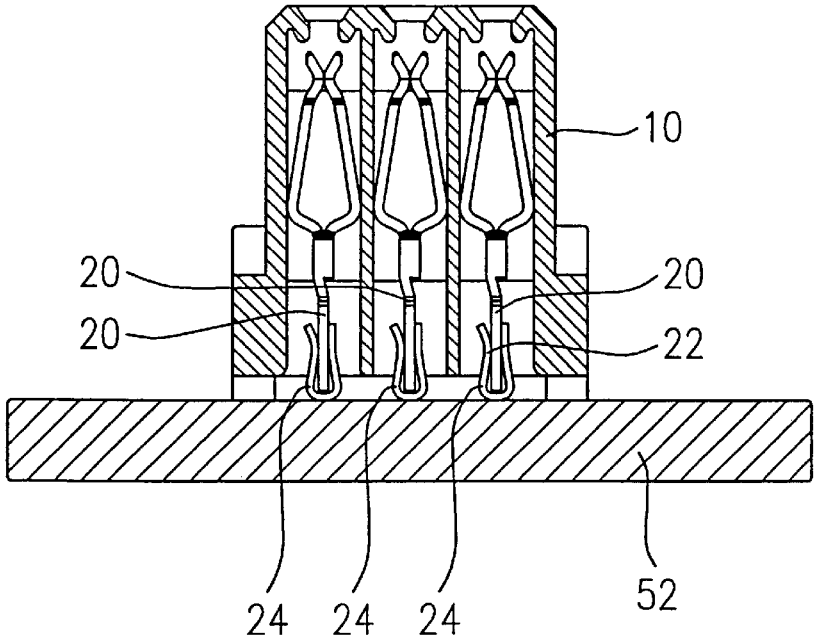
FIG. 8 is a sectional view of a plug connector according to a second variant of the embodiment shown in FIG. 6.

FIG. 8 represents a second variant of the embodiment shown in FIG. 6. In contrast to the embodiment shown in FIG. 6, this does not concern an angled multiple-contact strip, but a straight multiple-contact strip; thus, the contact springs of the individual contact members extend perpendicularly with respect to the circuit board plane. A further difference resides in that no pass-through mounting contact members, but surface mounting contact members 20 are used exclusively.

Figure 9:
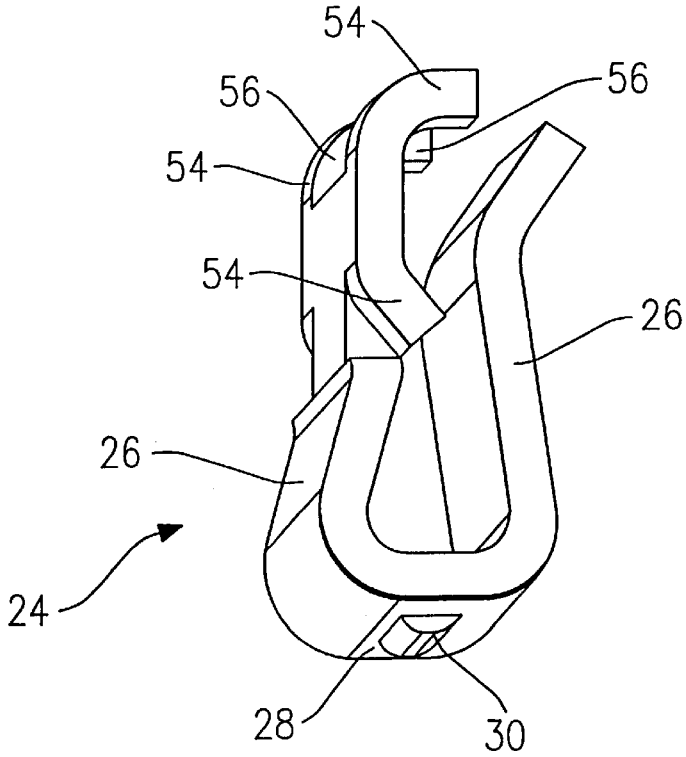
FIG. 9 is an isometric view of a connecting member for use with the plug connector according to the second embodiment.

FIG. 9 shows the connecting member 24 which is used with the surface mounting contact members 20 of the plug connectors shown in FIGS. 6 to 8. As regards its structure, the connecting member substantially corresponds to the connecting member known from FIGS. 1 to 4, however it is slightly modified.

In the plug connectors shown in FIGS. 6 to 8, the connecting region of the surface mounting contact members 20 comprises a rectangular cross-section. Thus, the connecting member 24 which engages the connecting region with the two oppositely situated legs 26, is roughly guided per se. In order to prevent the connecting member from slipping off the connecting region, bent-off noses 54 are provided on one of the legs 26 of the connecting member 24, whose surfaces being opposite to each other act as guide surfaces 56. These may engage the narrow outer surfaces of the connecting regions 22 and prevent the connecting member 24 from being tilted excessively or even from slipping off.

Figure 10:
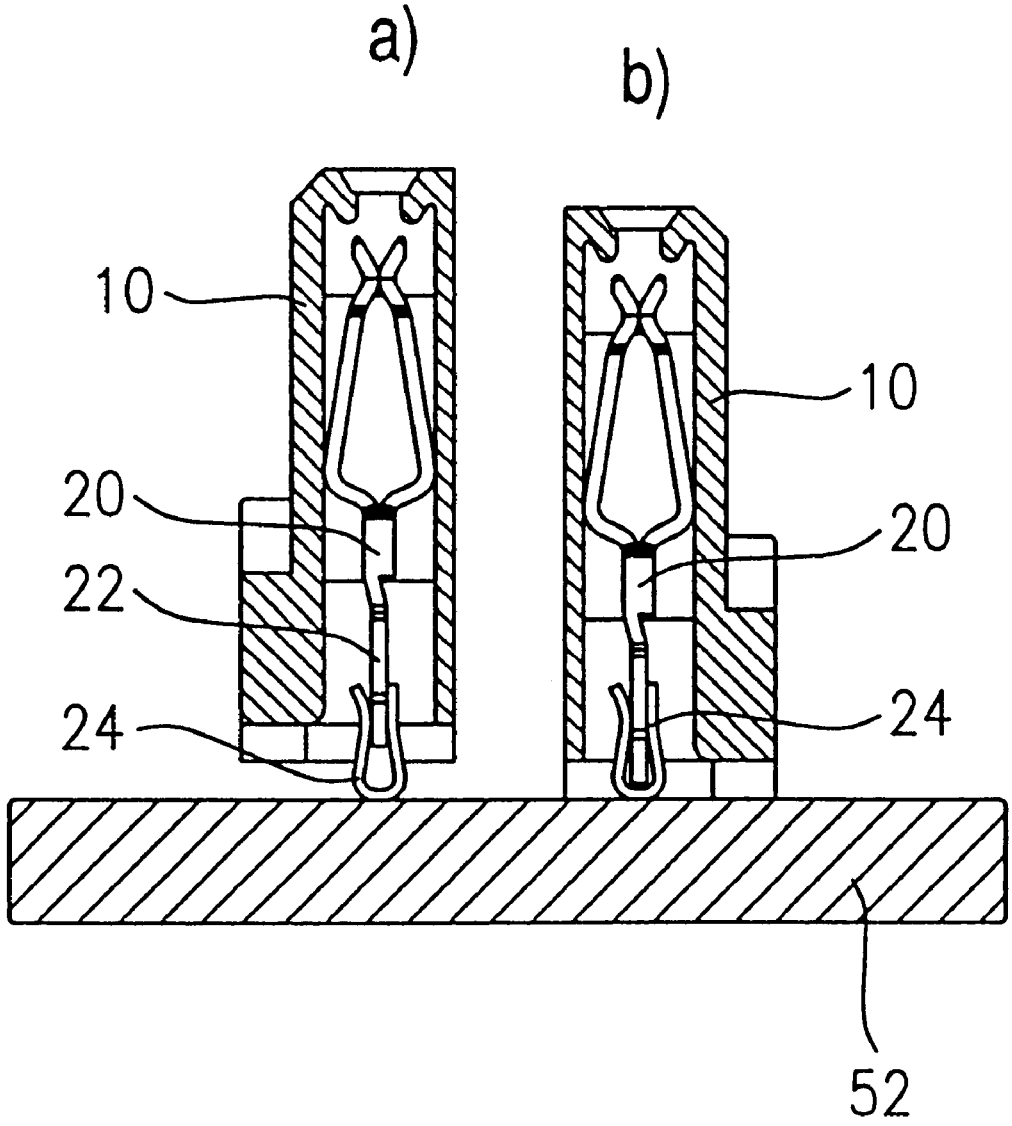
FIGS. 10*a* and 10*b* are each sectional views of a plug connector according to the second embodiment in a condition before and after mounting on a circuit board.

In the following, the mounting process of a plug connector like the one shown in FIGS. 6 to 8 will be described upon reference to FIG. 10. After assembly of the plug connector, the connecting member 24 is in the mounting position to be taken from FIG. 10*a*. In the mounting position, the connecting member 24 extends comparatively far from the plug connector. When the plug connector is put onto the circuit board (see FIG. 10*b*), the connecting member 24 on the connecting region 22 is further displaced towards the center of the plug connector. This relative displacement has an end as soon as the plug connector is completely put onto the circuit board 52 and the optionally provided pass-through mounting contact members are inserted into the corresponding openings 50. In this condition, the connecting member 24 may be soldered to the corresponding conductor track of the circuit board 52 since the required spacing between the bottom of the connecting member and the circuit board has materialized due to the spacer 30 being provided.

What is claimed is:

1. A plug connector for mounting on a circuit board and having a carrier body (10, 12) and characterized in that it is a coaxial-contact plug connector, at least one surface mounting contact member (20) is disposed within the carrier body comprising, at one end, a plug-in region for connection with a complementary plug connector and, at the other end, a connecting region (22) for electrical connection with the conductor track of a circuit board (52), characterized in that the contact member comprises a connecting member (24) which is connected with the connection region (22) in a mechanically flexible and electrically conductive manner, the connecting member being soldered to the conductor track on a surface of the circuit board (52) such that the connecting member (24) is in electrical engagement between the contact member (20) and the surface of the circuit board (52).

2. The plug connector according to claim 1, characterized in that the connecting member (24) is slidably mounted on the connection region (22).

3. A plug connector for mounting on a circuit board and having a carrier body (10, 12), at least one surface mounting contact member (20) is disposed within the carrier body, the contact member comprising, at one end, a plug-in region for connection with a complementary plug connector and, at the other end, a connecting region (22) for electrical connection with the conductor track of a circuit board (52), the contact member (20) having an insulating body (32) and a coaxial plug contact (14) which includes a pin-shaped inner conductor (16) within the insulating body, at least one connecting member (24) connected with the connection region (22) in a mechanically flexible and electrically conductive manner, the connecting member being soldered to the conductor track on a surface of the circuit board (52) such that the connecting member (24) is in electrical engagement between the pin-shaped inner conductor (16) within the insulating body (32) of the contact member (20) and the surface of the circuit board (52), characterized in that the connecting member (24) is slidably mounted on the connection region (22), characterized in that, before the plug connector is mounted on the circuit board (52) the connecting member (24) is in a mounting position in which it projects farther from the plug connector than after mounting.

4. The plug connector according to claim 3, characterized in that the connecting member (24) is a resilient clamp engaging the connecting region.

5. The plug connector according to claim 4, characterized in that the connecting region (22) is formed to be spherical.

6. The plug connector according to claim 1, characterized in that the contact member is provided with an insulating body (32) which constitutes a guide for the connecting member.

7. The plug connector according to claim 6, characterized in that the insulating body is provided with contact faces (36) for the connecting member (24), which are opposite each other at a spacing larger than the corresponding dimension of the connecting member (24) in this region.

8. The plug connector according to claim 1, characterized in that the connecting region has a rectangular cross-section.

9. The plug connector according to claim 8, characterized in that the connecting member (24) is provided with a plurality of guide surfaces (56) which engage the opposite edges of the connecting region (22).

10. The plug connector according to claim 9, characterized in that the guide surfaces (56) are formed on bent-off noses (54) of the connecting member (24).

11. The plug connector according to claim 1, characterized in that the connecting member (24) comprises two legs (26) engaging the connecting region, as well as a bottom (28) connecting the two legs with each other and facing towards the circuit board, and that the bottom is provided with a spacer (30) which ensures a predetermined spacing between the bottom and the circuit board.

12. The plug connector according to claim 11, characterized in that the spacer (30) is formed as a raised portion having an apex which is disposed against the circuit board.

13. The plug connector according to claim 1, characterized in that the connecting member is connected with the connecting region via a bond wire.

14. The plug connector according to claim 1, characterized in that there is further provided at least one pass-through mounting contact member (38).

15. The plug connector according to claim 14, characterized in that the pass-through mounting contact member (38) is an earth contact and the surface mounting contact member is a signal contact.

16. The plug connector according to claim 1, characterized in that the surface mounting contact member constitutes the inner conductor (16) of a coaxial contact and the pass-through mounting contact member is an earth sheet metal (38) connected with an outer conductor (18) of the coaxial contact.

17. The plug connector according to claim 1, characterized in that the connecting member (24) is a resilient clamp engaging the connecting region.

18. The plug connector according to claim 17, characterized in that the connecting region (22) is formed to be spherical.

19. The plug connector according to claim 3 wherein the insulating body (32) includes a guide web (34) which extends between contact faces (36) for guiding the connecting member (24) about the connecting region (22).

20. The plug connector according to claim 19 characterized in that the connecting member (24) comprises two legs (26), the guide web (34) being received between the two legs.

* * * * *